US005477580A

United States Patent [19]

Buysse

[11] Patent Number: 5,477,580

[45] Date of Patent: Dec. 26, 1995

[54] GROUT BRUSH FOR A ROTARY FLOOR MACHINE

[75] Inventor: Jeffery T. Buysse, St. Louis, Mo.

[73] Assignee: Clarke Industries, Inc., St. Louis, Mo.

[21] Appl. No.: 312,456

[22] Filed: Sep. 26, 1994

[51] Int. Cl.[6] ..... A47L 11/162; A47L 11/164; A46B 9/02

[52] U.S. Cl. ..... 15/180; 15/49.1

[58] Field of Search ..... 15/180, 192, 198, 15/87, 49.1, 50.1, 385, 195

[56] References Cited

U.S. PATENT DOCUMENTS

| | | | |
|---|---|---|---|
| 1,557,166 | 10/1925 | Horn | 15/180 |
| 2,291,740 | 8/1942 | Menkhaus | 15/50.1 |
| 3,181,193 | 5/1965 | Nobles et al. | 15/114 |
| 3,678,529 | 7/1972 | Woods et al. | 15/180 |
| 4,114,225 | 9/1978 | Malish et al. | 15/230 |
| 4,615,064 | 10/1986 | Alvin | 15/180 |

FOREIGN PATENT DOCUMENTS

| | | | |
|---|---|---|---|
| 8502522 | 6/1985 | WIPO | 15/180 |

*Primary Examiner*—Edward L. Roberts, Jr.
*Attorney, Agent, or Firm*—Senniger, Powers, Leavitt & Roedel

[57] ABSTRACT

A brush for a rotary floor machine is especially adapted to clean grout on tile floors. The brush includes a disk having a plurality of first and second bores arranged into a plurality of rings disposed about one face of the disk. Each ring defines an arcuate pattern of alternating first and second bores. The first bores are angled inwardly towards the center of the disk, preferably 5° from a line normal to the plane of the disk. The second bores are angled outwardly toward the periphery of the disk, preferably 5° from a line normal to the plane of the disk. Tufts of bristles disposed within the first and second bores thus form pairs of overlapping bristles.

10 Claims, 2 Drawing Sheets

10
24
22
12
14
16
20
18

18
26
32
30
34
36
38
40
42
44
46
5°
C
3

GROUT BRUSH FOR A ROTARY FLOOR MACHINE

FIELD OF THE INVENTION

The present invention relates to rotary floor machines and, more particularly, to a specialized brush for rotary machines.

BACKGROUND OF THE INVENTION

Rotary floor machines for cleaning, stripping, and buffing floors are well known in the art. Such rotary floor machines utilize a disk designed to accomplish the specific task at hand. The disks are generally annular planar disks that are adapted to be releasably coupled to the driving unit of the rotary floor machine.

Many of the disks are brushes that have tufts of bristles that are arranged on a face of the disk for contact with the floor. The tufts are disposed within bores on the disk. Generally, the bores are arranged in specific patterns depending on the desired characteristics of the brush. A typical pattern is the arrangement of bores in graduating circles about the center to the periphery of the disk.

In U.S. Pat. No. 3,678,529 issued to Woods et al. on Jul. 25, 1972, the tufts of bristles are disposed in bores that are arranged in annular patterns. The bores are perpendicular to the plane of the disk face and, thus, the tufts are also perpendicular to the plane of the disk face.

In U.S. Pat. No. 2,291,740 issued to Menkhaus on Aug. 4, 1942 and U.S. Pat. No. 3,181,193 issued to Nobles et al. on May 4, 1965, the tufts are likewise arranged in circles about the disk. The bores of the innermost circle are substantially perpendicular to the plane of the disk face, while each outwardly adjacent ring of bores are gradually outwardly angled. This provides an outward flaring of the bristles in order to enable the brush to reach beyond the circumference of the supporting disk.

In U.S. Pat. No. 4,114,225 issued to Malish et al. on Sep. 19, 1978 a brush-like mounting device for rotary pads is disclosed. The mounting device includes rings of bristle tufts. In one embodiment, the tufts are gradually radially outwardly angled in outwardly adjacent rings. In another embodiment, the tufts angled radially inwardly, with radially outwardly adjacent rings of tufts gradually transitioning to radially outwardly angled tufts.

While these brushes are suitable for certain purposes, it has been found that the prior art rotary brushes lack in effective cleaning of tile floors, and more specifically of the grout characteristic of tile floors. Because the grout is below the surface of the tile, it is especially difficult to clean.

Such brushes as are known, including those described above, will flare outwardly upon use due to the weight of the machine and the rotation of the brush. Thus, the bristles are all generally oriented in one direction.

There are known special tile floor cleaning machines that utilize a cylindrical brush. However, this requires a separate machine to clean the grout.

It is thus an object of the present invention to provide a grout cleaning brush for a rotary floor machine in order to eliminate the need for a separate machine when cleaning tile and grout floors.

It is also an object of the present invention to provide a brush for a rotary floor machine.

SUMMARY OF THE INVENTION

In keeping with the above, the present invention provides an annular brush for a rotary floor machine that is especially adapted to clean grout. The grout brush is also applicable to automatic scrubbers as well.

In one form thereof, the brush includes a plurality of first and second bores disposed on a disk in which are received bristle tufts. The first and second bores are arranged in a series of rings about the center to the periphery of the disk, the rings being defined by alternating first and second bores. The first bores are angled radially inwardly with respect to an axis perpendicular to the surface of the disk, while the second bores are angled radially outwardly with respect to the perpendicular axis.

The angle and alternating pattern of the first and second bores naturally angle the tufts in an angularly opposing relationship.

The alternating pattern of the first and second bores creates overlapping or crossing bristles when the brush is rotating under load of the accompanying machine. It is this pattern of cross bristles about the face of the disk that provides the grout cleaning feature.

In a preferred embodiment of the present grout brush the first and second bores are angled 5° from the perpendicular axis in their respective radial direction.

The number of rings of bores is determined by the size or diameter of the disk.

The present invention provides a grout brush for, and adapted to be, operably rotatably coupled to a rotary floor machine or automatic scrubber. The grout brush comprises an annular plate defining an upper surface and a lower surface, and a plurality of rings defined by alternating first and second bores disposed in the lower surface. The first bores are radially outwardly offset 5° relative to a perpendicular axis relative to the lower surface. The second bores are radially inwardly offset 5° from the perpendicular axis. A bristle tuft is disposed in each of the first and second bores.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION

Figure 1:
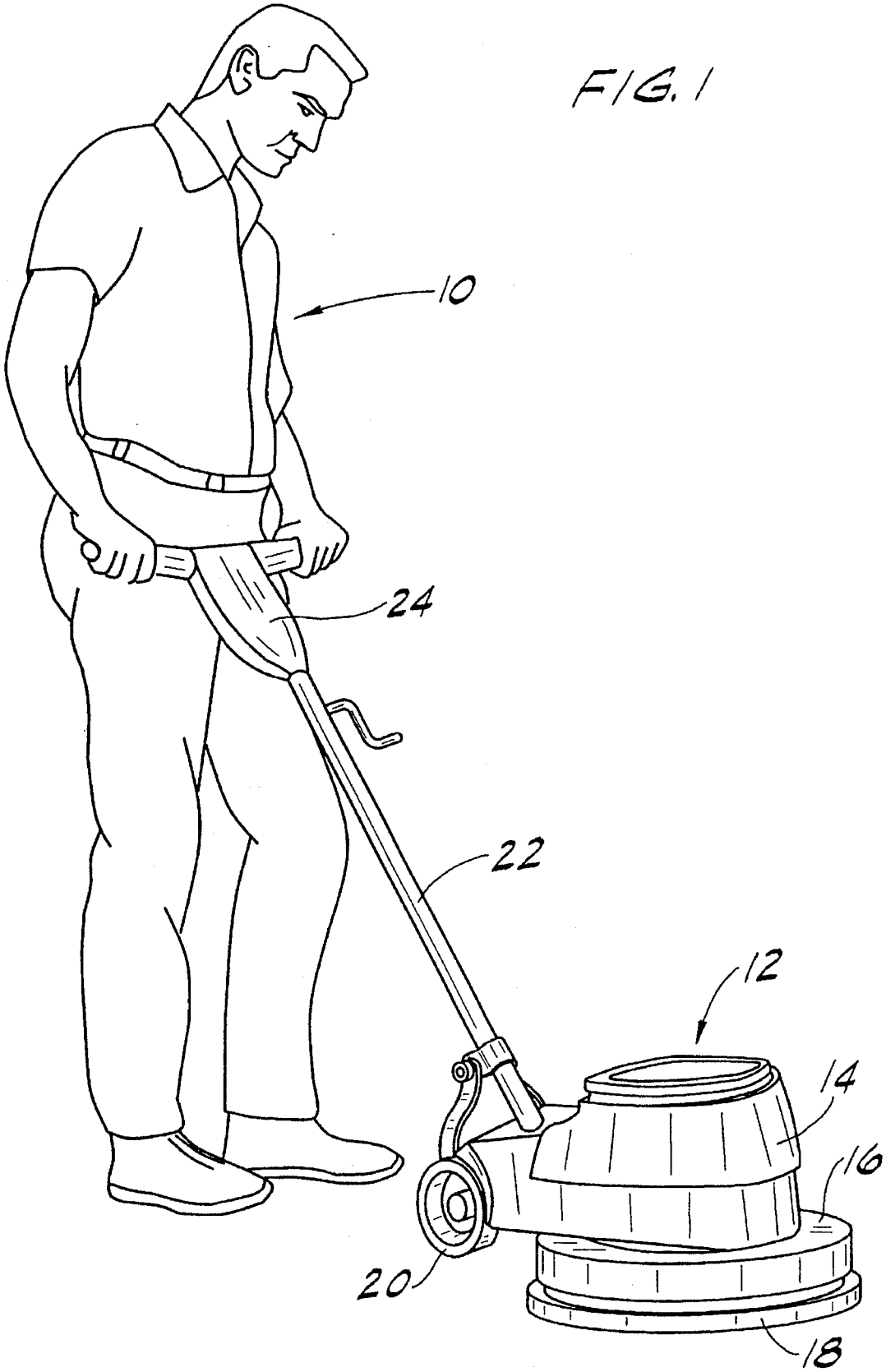
FIG. 1 is a perspective view of a man using a typical rotary floor machine of the type that utilizes a grout brush disk according to the present invention.

Referring now to FIG. 1 there is shown a man 10 utilizing a typical rotary floor machine 12. The rotary floor machine 12 includes a head portion 14 that houses a suitable motor (not shown) operable to rotatably drive a brush 18 such as that of the present invention and described hereinbelow with reference to the various Figures. Disposed between the head portion 14 and the brush 18 is a disk shroud 16. The floor machine 12 includes a pair of wheels, of which only one wheel 20 is shown, that are attached to the head portion 14. A handle tube 22 extends from the head portion 14 and terminates in a handle 24. The floor scrubber 12 is guided by the operator 10 via the handle 24. Generally, various machine controls (not shown) are operably associated with the handle 24 in order for the operator 10 to control the rotary floor machine 12.

Figures 2, 3, 4:
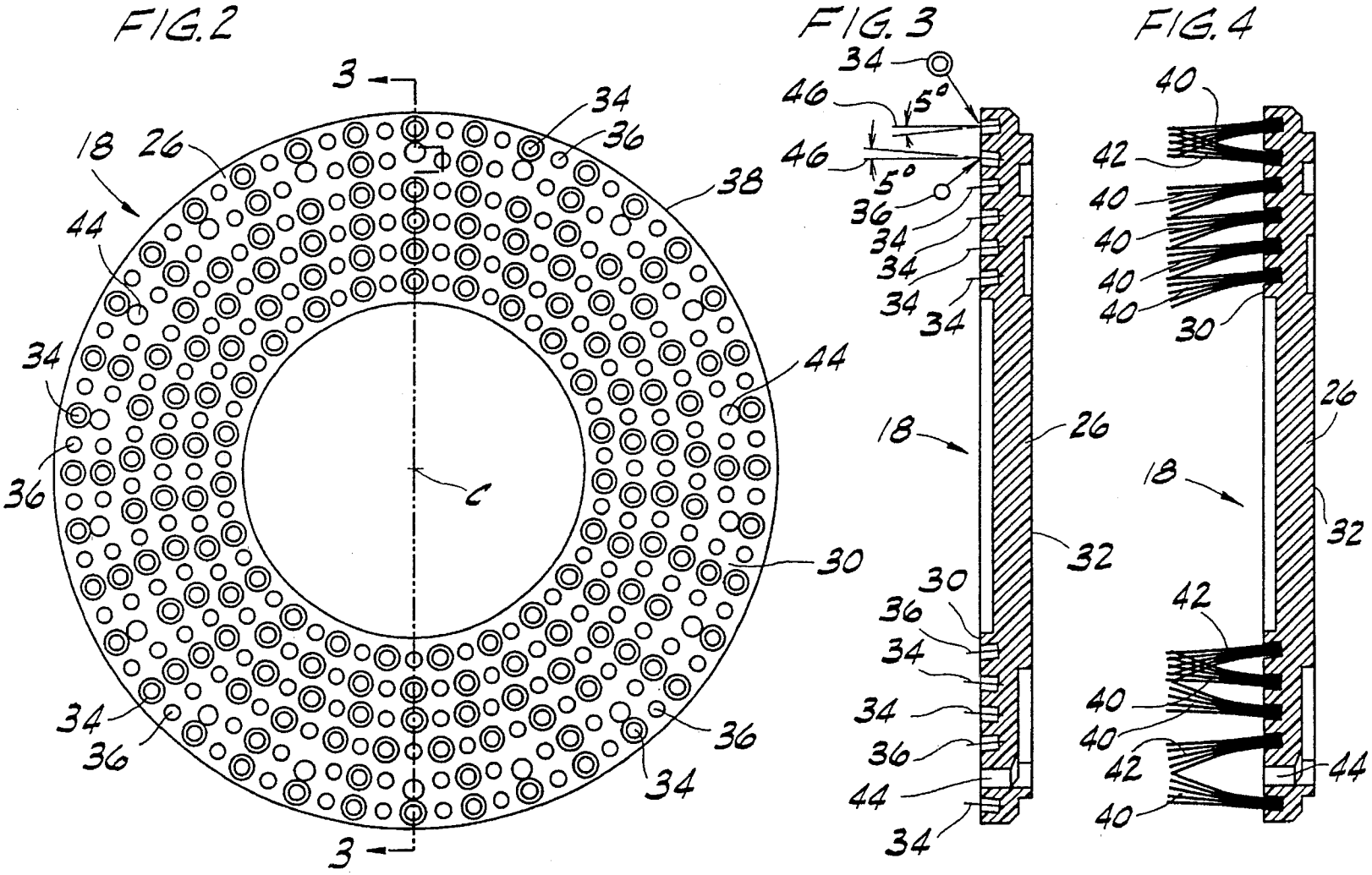
FIG. 2 is an enlarged view of the bottom of the grout brush disk according to the present invention with the bristles removed.
FIG. 3 is a side view of the present grout brush disk taken along line 3—3 of FIG. 2.
FIG. 4 is the FIG. 3 side view of the present grout brush disk with the bristles intact and in an unloaded state.

The rotary floor machine 12 is adapted to receive many types of disk-type brushes for performing such tasks as scrubbing, scouring, polishing, buffing, and the like. The present brush 18 is particularly adapted to clean grout between tile floors. With reference to FIGS. 2–4, the brush 18 comprises a disk structure 26 preferably of a plastic or wood construction having an approximately one (1) inch thickness or such as is customary in the art. In the model utilized for the drawings, the disk 26 had a diameter of 17 inches, although different size disks may and can use the teachings of the present invention. The disk 26 has a mounting member or hub 28 disposed in the center of the disk 26, the hub 28 adapted to operably attach to a cooperating drive structure (not shown) of the motor (not shown) of the rotary floor machine 12. The disk 26 defines a lower surface 30 and an upper surface 32. When the disk 26 is installed onto the floor machine 12, the upper surface 32 faces the head 14, while the lower surface 30 faces the surface to be cleaned, i.e. the floor.

The lower surface 30 includes a plurality of first bores 34 and a plurality of second bores 36 the depth of which is well known in the art, but in any event is adequate to contain the bristle tufts. In order to best understand the present invention, the bores 34 in FIG. 2 are represented as two concentric circles, while the bores 36 are represented as single small circles. The first and second bores 34 and 36 are arranged so as to form a plurality or series of rings of bores extending from proximate the hub 28 to proximate the periphery 38 of the disk 26. Naturally, the rings become larger in diameter from the hub 28 to the periphery 38.

In FIG. 2, there is shown six such rings of first and second bores 34, 36. However, it should be understood that there may be more or less rings of bores depending on the desired closeness of the grouping as well as the size of the disk 26. For the present 17 inch disk 26, the six rows of bores 34, 36 occupy 3½ inches on either radius. The first and second bores 34, 36 comprising or defining each ring are arranged in an alternating fashion such that a first bore 34 is adjacent a second bore 36, and a second bore 36 is adjacent a first bore 34. Stated in another way, each first bore 34 is disposed between two second bores 36, while each second bore 36 is disposed between two first bores 34 as on travels about each ring.

The first bores 34 are disposed in the disk 26 at a radially inward angle relative to an axis 46 defined as perpendicular to the plane of the lower surface 30 of the disk 26. The second bores are disposed in the disk at a radially outward angle relative to the axis 46 defined as perpendicular to the plane of the lower surface 30 of the disk 26. In the preferred form, both the first bore angle and the second bore angle are 5° as depicted in FIG. 3, although it should be recognized that other equally effective angles may be used. However, in keeping with the teaching of the present invention, the first bore angle is radially inward relative to the perpendicular axis 46, while the second bore angle is radially outward relative to the perpendicular axis 46. It should be understood that the first and second bores 34, 36 are adapted to receive tufts of bristles.

Referring now to FIG. 4, tufts or bundles of bristles 40 are shown disposed within first bores 34, while tufts or bundles of bristles 42 are shown disposed within second bores 36. The brush 18 is shown in an unloaded uncompressed state. The bristles may be made of a nylon, polypropylene, or similar material. The bristles may be, and in a preferred form are, Tynex® (DuPont) fibers or Tynex® coated fibers. As can best been seen in FIG. 4, the first tufts 40 of one ring cross with the second tufts 42 of another ring and vice versa. The overlapping pattern of tufts provide the improved grout cleaning feature.

Preferably, the first and second tufts 40, 42 are of the same length. The disk 26 also includes mounting bores 44 spaced thereon. When the brush 18 is affixed to the respective machine, the brush 18 is compressed against the floor due to the weight of the machine. The opposing tufts 40, 42, which overlap as depicted in FIG. 4 when uncompressed, overlap or cross more for grout cleaning when in the loaded or compressed state.

While the foregoing is directed to the preferred embodiment of the present invention, other and further embodiments of the invention may be devised without departing from the basic scope thereof, and the scope thereof is determined by the claims which follow.

What is claimed is:

1. A brush adapted to be operably coupled to a rotary floor machine, automatic floor scrubber, or the like, the brush comprising:

a disk defining a center and a periphery;

a plurality of first bores in a face of said disk disposed between said center and said periphery, said first bores angled radially inward;

a plurality of second bores in said face of said disk disposed between said center and said periphery, said second bores angled radially outward; and a bristle tuff disposed in each of said plurality of first and second bores;

each one of said plurality of first bores arranged on said face of said disk so as to be arcuately adjacent to one of said plurality of second bores.

2. The brush of claim 1, wherein said plurality of first and second bores are arcuately arranged so as to additionally define a plurality of rings about said center.

3. The brush of claim 2, wherein the number of said plurality of rings is dependent upon the size of said disk.

4. The brush of claim 1, wherein said plurality of first and second bores are angled 5° from an axis perpendicular to said face of said disk.

5. A grout brush for a rotary floor machine, automatic floor scrubber, or the like, the grout brush comprising:

an annular disk defining an upper surface and a lower surface;

a plurality of first bores disposed in said lower surface, said plurality of first bores having a longitudinal axis that is radially outwardly angled with respect to an axis perpendicular to said lower surface;

a plurality of second bores disposed in said lower surface, said plurality of second bores having a longitudinal axis that is radially inwardly angled with respect to the perpendicular axis; and a bristle tuft disposed in each of said plurality of first and second bores;

said plurality of first and second bores forming a plurality of rings about said disk, each one of said plurality of rings having a pattern of alternating first and second bores.

6. The grout brush of claim 5, wherein the number of said plurality of rings is dependent upon the size of said disk.

7. The grout brush of claim 5, wherein said plurality of first and second bores are angled 5° from the perpendicular axis.

8. A grout brush for, and adapted to be, operably rotatably coupled to a rotary floor machine, automatic floor scrubber, or the like, the grout brush comprising:

an annular plate defining an upper surface and a lower surface;

a plurality of rings, each one of said plurality of rings defined by alternating first and second bores disposed in said lower surface, said first bores being radially outwardly offset from a perpendicular axis relative to said lower surface, said second bores being radially inwardly offset from the perpendicular axis; and a bristle tuft disposed in each of said first and second bores.

9. The grout brush of claim 8, wherein said offset of said first and second bores is 5°.

10. The grout brush of claim 8, wherein the number of said plurality of rings is dependent upon the size of said disk.

* * * * *